US005302217A

United States Patent [19]

Gostic et al.

[11] Patent Number: 5,302,217

[45] Date of Patent: Apr. 12, 1994

[54] CYCLIC HEAT TREATMENT FOR CONTROLLING GRAIN SIZE OF SUPERALLOY CASTINGS

[75] Inventors: William J. Gostic, Tequesta; Charles M. Biondo, Jupiter, both of Fla.; Timothy P. Fuesting, Lynchburg, Va.

[73] Assignee: United Technologies Corporation, Hartford, Conn.

[21] Appl. No.: 995,438

[22] Filed: Dec. 23, 1992

[51] Int. Cl.[5] ..... C22F 1/10

[52] U.S. Cl. ..... 148/675; 148/410; 148/674; 148/555

[58] Field of Search ..... 148/674, 675, 555, 562, 148/410

[56] References Cited

U.S. PATENT DOCUMENTS

| | | | |
|---|---|---|---|
| 3,028,268 | 4/1962 | Tisinai et al. | 148/675 |
| 3,677,830 | 7/1972 | Cox et al. | 148/675 |
| 4,253,884 | 3/1981 | Maurer et al. | 148/675 |
| 4,336,079 | 6/1982 | Owens | 148/676 |
| 4,820,356 | 4/1989 | Blackburn et al. | 148/675 |
| 5,074,925 | 12/1991 | Gostic et al. | 148/562 |

*Primary Examiner*—R. Dean
*Assistant Examiner*—Margery S. Phipps
*Attorney, Agent, or Firm*—Charles E. Sohl

[57] ABSTRACT

Superalloy castings having large variations in section thickness are heat treated using a cyclic stress relief procedure, with the temperature being cycled between about 50° F. (28° C.) and 150° F. (83° C.) below the second phase particle solvus temperature, to relieve the residual stresses incurred during cooling within the mold following casting, followed by a solution cycle at a temperature about 25° F. (14° C.) below the second phase particle solvus temperature to dissolve some or all of the second phase particles.

7 Claims, 1 Drawing Sheet

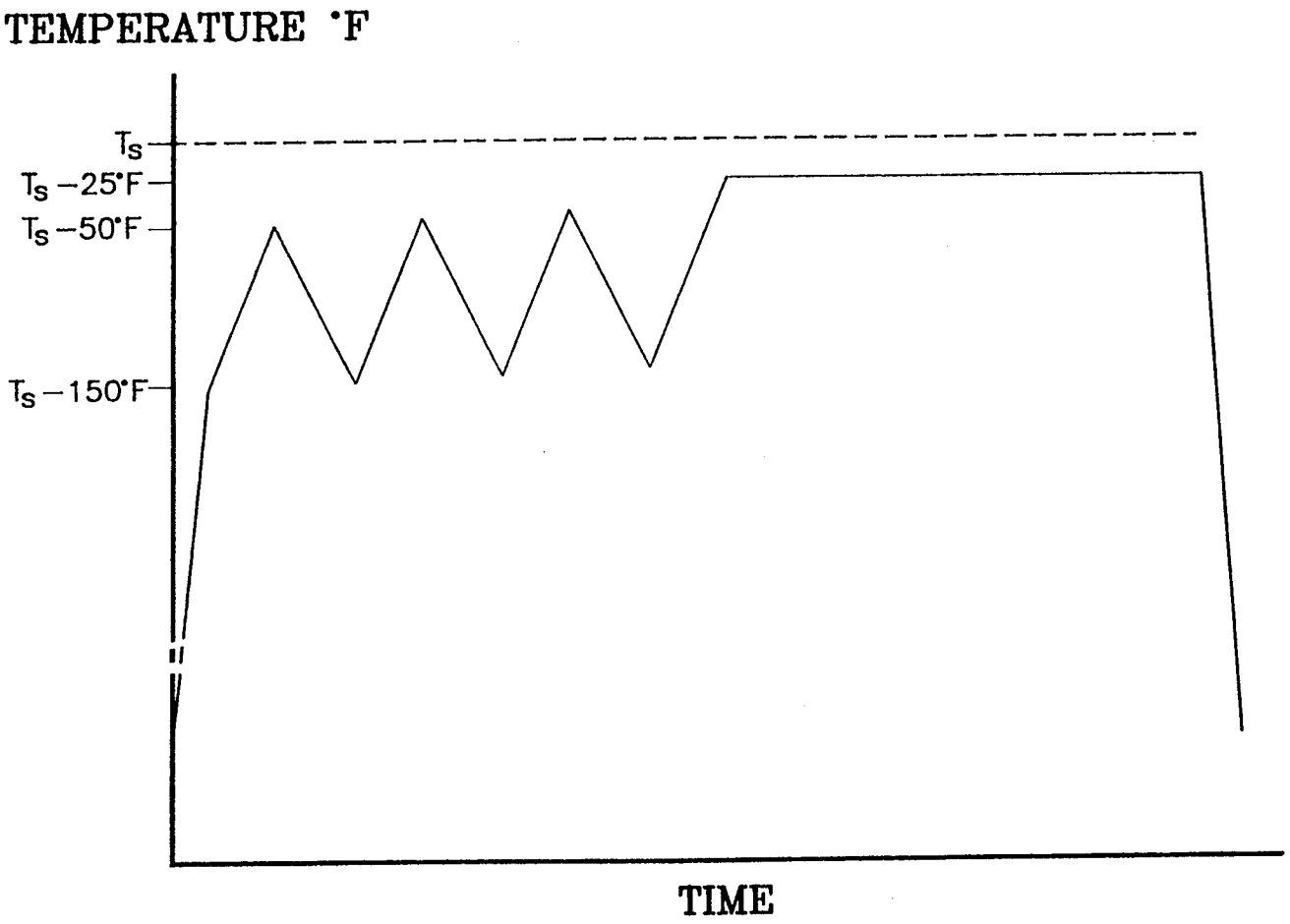
TEMPERATURE °F
$T_S$
$T_S - 25°F$
$T_S - 50°F$
$T_S - 150°F$
TIME

CYCLIC HEAT TREATMENT FOR CONTROLLING GRAIN SIZE OF SUPERALLOY CASTINGS

TECHNICAL FIELD

The present invention relates to the heat treatment of superalloy castings, and more particularly to the heat treatment of fine grain superalloy castings having both thick and thin sections such that grain growth due to residual stresses is substantially eliminated.

BACKGROUND ART

Superalloys are materials, usually nickel or cobalt based, which have useful properties at temperatures ranging from cryogenic to approximately 2000° F. (1093° C.). Thus the superalloys are useful in applications ranging from cryogenic turbopumps to gas turbine engines.

Nickel base superalloys generally consist of a $\gamma$ (nickel solid solution) matrix containing an array of particles which contribute to the strength of the material. The strengthening particles generally include, but are not limited to, $\gamma'$, $\gamma''$, and carbides. These strengthening particles are referred to hereinafter as second phase particles.

In addition to providing a strengthening mechanism for the superalloys, the second phase particles also control the grain size of the alloys during various high temperature processing operations by controlling dislocation and grain boundary movement.

Superalloy castings used in the aerospace industry frequently contain both thick and thin sections. The as cast microstructure is frequently relatively fine grained (ASTM 3.5–6.0). The fine grained microstructure provides mechanical properties, such as yield strength, tensile strength, ductility, high cycle fatigue and low cycle fatigue, which are highly desirable for these aerospace applications. Welding of the castings, such as for repair of casting or machining defects, is also more successful with a fine grained microstructure.

During cooldown within the mold following casting, high residual stresses can arise due to the variation in cooling rate in the thin and thick sections, with the thin sections generally being subjected to tensile stresses.

Processing of the castings to optimize the mechanical properties typically includes a homogenization or solution heat treatment which is designed to reduce local chemical variations (due to solidification processes) and to dissolve some or all of the second phase particles. This is followed by subsequent heat treatments designed to reprecipitate the second phase particles to provide a particle size and particle distribution which will optimize the required mechanical properties.

The homogenization heat treatment, which involves dissolving some or all of the second phase particles, may remove the primary barriers to grain boundary movement and produce subsequent grain growth. Grain growth due to the combination of existing high residual stresses and diminished resistance to grain boundary movement results in a generally coarse grain microstructure with occasional grains which are extremely large. In some cases extremely large single grains can extend through the entire wall thickness of thin portions of the casting. This result may be extremely detrimental to the mechanical properties needed for the particular application.

Both solutioning of certain second phase particles and the presence of residual casting stresses encourage the undesirable grain growth. Since solution of certain second phase particles is an essential step in developing the required mechanical properties, the elimination of casting residual stresses must be accomplished if excessive grain growth is to be avoided.

In most conventional alloys, stress relief heat treatments are conducted at temperatures well below those at which grain growth occurs. However, in superalloys the residual stresses are retained at much higher temperatures, approaching and perhaps even exceeding the second phase particle solvus temperature. Thus grain growth can easily occur during stress relief of superalloy components.

Cox, et al., in U.S. Pat. No. 3,677,830, of common assignee herewith, controlled grain growth in nickel base superalloys after working but before aging by subjecting the alloy to a duplex heat treatment consisting of a first heat treat step establishing a uniformity of the precipitated phase throughout the alloy microstructure under conditions of restricted growth due to the presence of a secondary phase, and a second heat treat step providing uniform solutioning of the secondary phase and controlled grain growth by relying upon grain annihilation under conditions of uniform strain energy distribution within the polycrystalline aggregate. These heat treatments were performed within 25°–100° F. (14°–56° C.) below the secondary phase solvus temperature, and resulted in a uniform, reproducible microstructure from which subsequent aging heat treatments were able to promote maximum alloy strength.

Blackburn, et al., in U.S. Pat. No. 4,820,356, of common assignee herewith, controlled grain growth in superalloy forgings by a three step heat treat process, with the first step being development of coarse grain boundary $\gamma'$ by a subsolvus solution treatment which puts the majority of the $\gamma'$ into solid solution but retains a sufficient amount as precipitates in the grain boundaries to prevent significant grain growth. The grain boundary precipitates are retained in the subsequent steps and effectively control grain growth.

Gostic, et al., in U.S. Pat. No. 5,074,925, of common assignee and sharing a common inventor with the present application, solution heat treated cast single crystal superalloy materials followed by forging or rolling steps at working temperatures about 50°–300° F. (28°–167° C.) below the $\gamma'$ solvus temperature. It was found necessary to relieve the residual stresses due to the deformation processes in order to prevent recrystallization of the single crystal material. Gostic, et al., determined that a cyclic annealing process, consisting of several increasing and decreasing temperature cycles within the temperature range of 50°–125° F. (14°–69° C.) below the Y' solvus temperature, alternated with the deformation steps, was effective in preventing the undesirable recrystallization.

DISCLOSURE OF INVENTION

The present invention provides a novel method for heat treating nickel and cobalt base superalloy castings which have large variations in section thickness. Accordingly, the present invention is directed to a method for relieving the residual stresses from the casting process prior to solution heat treatment in castings which have significant variations in section thickness, comprising the steps of stress relieving the casting in the temperature range of 50°–150° F. (28°–83° C.) below the second phase particle solvus temperature, followed by a solution heat treatment at a temperature about 25° F. (14° C.) below the second phase particle solvus temperature.

The range of temperature for the minimum and maximum temperatures for the cyclical portion of the heat treatment should be a minimum of 50° F. (28° C.), and a maximum of about 150° F. (83° C.).

The stress relief heat treatment may comprise two to ten cycles between the low and high ends of the stated temperature range at a rate of change of temperature between about 1° F. (0.6° C.) per minute and about 10° F. (6° C.) per minute. The solution heat treatment generally consists of heating for one to 30 hours at the specified temperature. In this manner, a fully stress relieved and solutioned casting can be achieved without producing substantial grain growth.

These, and other features and advantages of the invention, will be apparent from the description below, read in conjunction with the figure.

BRIEF DESCRIPTION OF FIGURE

The figure is a graphic representation of the stress relief cycle of the present invention.

BEST MODE FOR CARRYING OUT THE INVENTION

The use of superalloys is well known and established in the aerospace industry. Typical superalloys consist of a continuous $\gamma$ phase matrix, in which is interspersed an array of second phase particles generally including, but not limited to, Y', Y'', and carbides. The mechanical properties of superalloys are dependent on the type, size and distribution of the second phase particles within the continuous matrix.

To establish the characteristics of the distributed second phases, the alloy is generally heated to an elevated temperature to dissolve some or all of the second phase particles in the continuous matrix. By controlling the cooling process from the solution temperature, and by reheating the material in subsequent heat treatment processes, the second phase particles are reprecipitated, and the mechanical properties of the alloy are established.

In the fabrication of structural housings for the Space Shuttle Main Engine turbopumps, Inconel 718, modified slightly for cryogenic use, and having a nominal composition of 19 Cr, 19 Fe, 3.9 Mo, 4.9 (Cb+Ta), 0.9 Ti, 0.003 B, 0.6 Al, balance Ni, with all quantities being in weight per cent, was selected. The housing contains various interconnected portions having thick and thin cross-sections, with the ratio between thick and thin sections being as high as about 15:1.

In order to heat treat castings such as the turbopump housings, a unique heat treatment cycle was developed which comprises stress relieving the castings using a cyclic stress relief procedure, and solution heat treating to dissolve some or all of the second phase particles. Subsequent heat treat steps are then applied to reprecipitate the second phase particles so as to provide the properties required for the particular application.

The heat treatment cycle of this invention is depicted in the figure, which shows that the casting is heated rapidly to a temperature about 150° F. (83° C.) below the highest solvus temperature of the second phase particles which must be dissolved, and then subjected to a series of stress annealing cycles. The stress relieving cycles consist of increasing and decreasing the temperature at a fairly slow controlled rate between limit temperatures which are approximately 50° F. (28° C.) and 150° F. (83° C.) below the second phase particle solvus temperature. After a sufficient number of stress relief cycles, the temperature is increased to a temperature about 25° F. (14° C.) below the solvus temperature, and held for a time sufficient to dissolve some or all of the second phase particles. Suitable heating and cooling rates for this invention are from about 1° F. (0.6° C.) per minute to about 10° F. (6° C.) per minute, with the rates generally determined by the capability of the furnace being used. Two to ten temperature cycles are generally required for the cyclic stress relief procedure.

For the particular heat of Inconel 718 material used, in which Laves phase was present, the Laves phase solvus occurred at about 2050° F. (1121° C.). To relieve the residual stresses generated during the cooldown from the casting temperature, the housing was heated to a temperature of approximately 1900° F. (1038° C.). The housing was then cycled through a series of temperature cycles wherein the temperature ranged from 1900° F. (1038° C.) to 2000° F. (1093° C.). The heating and cooling portions of each stress relief cycle were conducted at about 2° F. (1.1° C.) per minute and a total of two cycles were performed.

After completion of the cyclic stress relief procedure the housing was solution heat treated at a temperature of about 2025° F. (1107° C.) for 30 hours. The heat treat procedure of this invention, including the cyclic stress relief heat treatment and the solution cycle, effectively homogenized the superalloy material without producing significant grain growth.

By comparison a similar turbopump housing was subjected to a homogenization cycle, which was performed at a temperature of about 2025° F. (1107° C.) for a period of about 36 hours. This homogenization cycle resulted in abnormal grain growth in the housing, demonstrating that the residual casting stresses were not effectively relieved at the homogenization temperature.

While one of average skill in the art would anticipate that a constant temperature stress relief cycle would alleviate typical grain growth problems, we were surprised to find that this did not occur. Instead, the cyclic stress procedure of this invention was found to be successful in avoiding grain growth, even though the temperatures used were lower than tried for the constant temperature stress relief. Although more extensive testing would likely provide us with a mechanism for this behavior, the investigation was not carried to that extent.

One of average skill in the art of this invention will realize that the principles of this invention will apply to other superalloys which depend on a precipitated second phase as a part of the strengthening mechanism, and that the appropriate solvus temperature will generally be that for the second phase particles having the highest solvus temperature among those particles which must be dissolved.

One of average skill in the art will also realize that the times and temperatures specified herein are dependent on the compositions of the alloys used and the physical nature of the components to which the procedures are applied. For instance, the post stress relief solution cycle will range from about one hour to 30 hours or more, depending largely on the size and mass of the particular component, and on the soak times and homogenization times required to achieve sufficient uniformity within the component.

Although this invention has been shown and described with respect to detailed embodiments thereof, it will be understood by those skilled in the art that various changes, omissions and additions in form and detail thereof may be made without departing from the spirit and scope of the claimed invention.

We claim:

1. A method for heat treating superalloy castings, comprising the steps of:

a. cyclically annealing the casting with a cyclic heat treatment that cycles in a temperature range with low and high ends of about 50°–150° F. (28°–83° C.) below a second phase particle solvus temperature, respectively; and b. after cyclically annealing, solution heat treating the castings at a temperature about 25° F. (14° C.) below the second phase particle solvus temperature.

2. The method as recited in claim 1 wherein the superalloy castings have a grain size of ASTM 3.5–6.0.

3. The method is recited in claim 1 wherein the superalloy castings have both thick and thin sections.

4. The method as recited in claim 1 wherein each cyclic annealing treatment comprises from two to ten cycles between the low and high ends of the temperature range.

5. The method as recited in claim 1 wherein the temperature is changed within each cyclic annealing treatment at a rate between about 1° F. (0.6° C.) per minute and about 10° F. (6° C.) per minute.

6. The method as recited in claim 1 wherein the temperature is changed within each cyclic annealing treatment at a rate of about 2° F. (1.1° C.) per minute.

7. The method as recited in claim 1 wherein the castings are solution heat treated for from about one up to about 30 hours.

* * * * *